US010827806B1

(12) United States Patent
Nambu et al.

(10) Patent No.: US 10,827,806 B1
(45) Date of Patent: Nov. 10, 2020

(54) BELT HOLDING STRUCTURE

(71) Applicant: YKK Corporation, Tokyo (JP)

(72) Inventors: Madoka Nambu, Toyama (JP); Hitoshi Kaneko, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 16/430,866

(22) Filed: Jun. 4, 2019

(51) Int. Cl.
*A44B 11/12* (2006.01)
*A44B 11/16* (2006.01)
*A44B 11/26* (2006.01)
*A44B 11/25* (2006.01)

(52) U.S. Cl.
CPC ..... *A44B 11/16* (2013.01); *A44B 11/2592* (2013.01); *A44B 11/266* (2013.01)

(58) Field of Classification Search
CPC .... A44B 11/16; A44B 11/2592; A44B 11/266
See application file for complete search history.

(56) References Cited

U.S. PATENT DOCUMENTS 2,816,339 A * 12/1957 Prete, Jr. ..... A44B 11/14 24/170
2,981,993 A * 5/1961 Elsner ..... B60P 7/0823 24/170
3,413,691 A * 12/1968 Elsner ..... A44B 11/14 24/170
3,678,542 A * 7/1972 Prete, Jr. ..... B60P 7/0823 24/191
5,161,351 A * 11/1992 Woodruff ..... A44B 11/14 24/170
5,839,174 A * 11/1998 Chamings ..... B60R 22/48 24/633
5,893,199 A 4/1999 Anscher
5,920,963 A * 7/1999 Chou ..... F16G 11/106 24/170
6,543,096 B2 * 4/2003 Settelmayer ..... A44B 11/12 24/170
6,735,826 B2 * 5/2004 Uehara ..... A44B 11/12 24/170
6,868,585 B2 * 3/2005 Anthony ..... A44B 11/14 24/134 R
8,327,507 B2 * 12/2012 Eisinger ..... B60N 2/2812 24/168
8,327,513 B2 * 12/2012 Keene ..... A44B 11/2526 24/637
8,464,402 B2 * 6/2013 Mamie ..... B60P 7/0823 24/170

(Continued)

*Primary Examiner* — Jason W San
(74) *Attorney, Agent, or Firm* — Kilpatrick Townsend & Stockton LLP

(57) ABSTRACT

In a cross-section perpendicular to the extending direction of a support part, a first bar has a holding part that holds a belt together with a leading end part and a winding part on which the belt is wound. A third bar is positioned on one side of a virtual line α connecting a point at the holding part at which the belt is held together with the leading end part of a moving part and a point at the support part of the moving part before being moved. An operating part of the moving part extends from the support part to the other side relative to the virtual line α, and a biasing part of the moving part generates biasing force in such a direction that the leading end part is moved toward the first bar.

3 Claims, 9 Drawing Sheets

(56) References Cited

U.S. PATENT DOCUMENTS 8,561,267 B2 * 10/2013 Chang ..... A44B 11/12 211/89.01
8,635,746 B2 * 1/2014 Bellamy ..... A61B 17/1327 24/170
9,010,824 B2 * 4/2015 Hayes ..... B65G 7/12 294/150
9,149,091 B2 * 10/2015 Ishii ..... A44B 11/12
9,351,539 B2 * 5/2016 Briggs ..... A43C 11/146
9,622,547 B2 * 4/2017 Seader ..... A44B 11/12
2001/0039696 A1 * 11/2001 Maciejczyk ..... A44B 11/14 24/170
2006/0075609 A1 * 4/2006 Dingman ..... B60R 22/20 24/68 CD
2006/0261649 A1 * 11/2006 Baldwin ..... B60N 2/2812 297/250.1
2007/0193004 A1 * 8/2007 Chou ..... A44B 11/006 24/170
2007/0226961 A1 * 10/2007 Anderson ..... A44B 11/2588 24/170
2008/0010786 A1 * 1/2008 Huang ..... A44B 11/12 24/170
2008/0010791 A1 * 1/2008 Huang ..... B60P 7/0823 24/68 CD
2008/0148529 A1 * 6/2008 Huang ..... A44B 11/14 24/170
2011/0146034 A1 * 6/2011 Ng ..... A44B 11/2523 24/640
2013/0180085 A1 * 7/2013 Chang ..... A44B 11/12 24/191
2015/0314749 A1 * 11/2015 Moker ..... A44B 11/2557 297/464
2016/0166013 A1 * 6/2016 Szewczyk ..... A44B 11/125 297/468
2016/0174665 A1 * 6/2016 Kung ..... A44B 11/12 24/170
2016/0360837 A1 * 12/2016 Costenbader ..... B60P 7/0823

* cited by examiner (b)

BELT HOLDING STRUCTURE

BACKGROUND OF THE INVENTION AND RELATED ART STATEMENT

The present invention relates to a belt holding structure attached to a belt or the like so as to be engageable with another member, an engaging member, an engaging device, and a buckle.

There is disclosed a buckle that engages a plug and a socket attached to a belt or the like to fix an article (see U.S. Pat. No. 5,893,199). FIG. 9 illustrates the outline of a belt holding structure in a conventional buckle 101. A plug 102 has at least a base part 110, an engaging part 120, and a moving part 130. A leg part 121 as the engaging part 120 is integrally fixed to the base part 110, and the moving part 130 is movably attached thereto.

The base part 110 has two opposing wall parts 111, a first bar 112 connecting the two wall parts 111 at a position separated away from the engaging part 120, and a second bar 113 connecting the two wall parts 111 at a position further apart from the engaging part 120 than the first bar 112 is from the engaging part 120. The engaging part 120 has a third bar 121 connecting the two wall parts 111 at its leading end on the base part 110 side.

In a normal state, a leading end part 133 of the moving part 130 is held in a direction contacting the first bar 112 by basing force caused by curving a support part 134. Operating an operating part 132 causes the leading end part 133 to be separated from the first bar 112 against the biasing force of the support part 134 held in position by the third bar 121. A belt 105 passes between the leading end part 133 and the first bar 112. The belt 105 is held between the leading end part 133 and the first bar 112 in a normal state and becomes movable when the operating part 132 is operated to move the leading end part 133.

As illustrated in FIG. 9, the plug 102 described in U.S. Pat. No. 5,893,199 is configured as follows. That is, when one side 105*a* of the belt 105 and the other side 105*b* of the belt 105 are both positioned in a first direction A, the belt 105 directly or indirectly contacts the first and second bars 112 and 113 on the one side 105*a* and the other side 105*b* from the position at which it is held between the leading end part 133 and the first bar 112. Thus, even if the moving part 130 slightly moves for some reason to cause the belt 105 to come off from between the leading end part 133 and the first bar 112, the belt 105 can maintain its stable state by friction with the first bar 112 and second bar 113.

However, when the other side 105*b* of the belt 105 is positioned in a second direction C, the belt 105 does not contact the base part 110 of the plug 102 on the other side 105*b* from the position at which it is held between the leading end part 133 and the first bar 112. Thus, if the moving part 130 slightly moves for some reason to cause the belt 105 to come off from between the leading end part 133 and first bar 112, the belt 105 loosens to become unstable.

SUMMARY OF THE INVENTION

A belt holding structure according to one embodiment of the present invention includes a base part and a moving part. The base part includes: two wall parts arranged spaced from each other; a first bar disposed so as to extend over the two wall parts; a second bar disposed so as to be separated from the first bar and to extend over the two wall parts; and a third bar disposed so as to be separated from the first bar and second bar and to extend over the two wall parts. The moving part includes: a support part relatively movably attached to the wall parts; an operating part extending from the support part; a leading end part extending from the support part toward the first bar; a biasing part extending while being curved from the support part toward the second bar; and a contacting part extending from the biasing part and contacting, at least partially, the second bar. In a cross-section perpendicular to the extending direction of the support part, the first bar has a holding part that holds a belt together with the leading end part and a winding part on which the belt is wound, the third bar is positioned on one side of a virtual line connecting a point at the holding part at which the belt is held together with the leading end part and a point at the support part before being moved, the operating part extends from the support part to the other side relative to the virtual line, and the biasing part generates biasing force in such a direction that the leading end part moves toward the first bar.

In the belt holding structure according to the embodiment, the third bar is positioned on the second bar side of the holding part, and the holding part is formed by a surface facing the third bar side.

In the belt holding structure according to the embodiment, the moving part is rotated about the support part, and the leading end part is biased to the holding part from the third bar side.

In the belt holding structure according to the embodiment, the moving part has an extension part extending from the contacting part contacting the second bar in a direction away from the second bar.

An engaging member according to one embodiment of the present invention includes: the belt holding structure; and an engaging part provided at an end portion of the base part on the side closer to the first bar and engaged with another member.

The engaging member according to the embodiment further includes a belt wound on the first bar between the engaging part and the first bar from the one side of the virtual line to the other side thereof, passing the holding part between the first bar and the leading end part from the other side of the virtual line to the one side thereof, and contacting the third bar on the one side of the virtual line.

An engaging device according to one embodiment of the present invention includes: the engaging member; and an engaged member having an engaged part detachably engaged with the belt holding structure and the engaging part of the engaging member.

In the engaging device according to the embodiment of the present invention, the engaged member includes a belt wound on the first bar between the engaged part and the first bar of the belt holding structure from the one side of the virtual line to the other side thereof, passing the holding part between the first bar and the leading end part, and contacting the third bar on the one side of the virtual line.

A buckle according to one embodiment of the present invention includes a plug and a socket. The plug includes: an engaging side base part having two engaging side wall parts arranged spaced from each other, an engaging side first bar provided so as to extend over the two engaging side wall parts, an engaging side second bar provided so as to be separated from the engaging side first bar and to extend over the two engaging side wall parts, and an engaging side third bar provided so as to be separated from the engaging side first bar and the engaging side second bar and to extend over the two engaging side wall parts; and an engaging side moving part having a leg part extending to the side opposite to the engaging side first bar from the end portion of the engaging side base part on the side closer to the engaging side first bar, an engaging side support part relatively movably attached to the engaging side wall parts, an engaging side operating part extending from the engaging side support part, an engaging side leading end part extending from the engaging side support part toward the engaging side first bar, an engaging side biasing part extending while being curved from the engaging side support part toward the engaging side second bar, and an engaging side contacting part extending from the engaging side biasing part and contacting, at least partially, the engaging side second bar, wherein in a cross-section perpendicular to the extending direction of the engaging side support part, the engaging side first bar includes an engaging side holding part that holds the engaging side belt together with the engaging side leading end part and an engaging side winding part on which the engaging side belt is wound, the engaging side third bar is positioned on one side of the engaging side virtual line connecting a point at the engaging side holding part at which the engaging side belt is held together with the engaging side leading end part and a point at the engaging side support part before being moved, the engaging side operating part extends from the engaging side support part to the other side relative to the engaging side virtual line, and the engaging side biasing part generates biasing force in such a direction that the engaging side leading end part is moved toward the engaging side first bar. The socket includes: an engaged side base part having two engaged side wall parts arranged spaced from each other, an engaged side first bar provided so as to extend over the two engaged side wall parts, an engaged side second bar provided so as to be separated from the engaged side first bar and to extend over the two engaged side wall parts, and an engaged side third bar provided so as to be separated from the engaged side first bar and engaged side second bar and to extend over the two engaged side wall parts; and an engaged side moving part having a fitting part extending to the side opposite to the engaged side first bar from the end portion of the engaged side base part on the side closer to the engaged side first bar, an engaged side support part relatively movably attached to the engaged side wall parts, an engaged side operating part extending from the engaged side support part, an engaged side leading end part extending from the engaged side support part toward the engaged side first bar, an engaged side biasing part extending while being curved from the engaged side support part toward the engaged side second bar, and an engaged side contacting part extending from the engaged side biasing part and contacting, at least partially, the engaged side second bar, wherein in a cross-section perpendicular to the extending direction of the engaged side support part, the engaged side first bar includes an engaged side holding part that holds the engaged side belt together with the engaged side leading end part and an engaged side winding part on which the engaged side belt is wound, the engaged side third bar is positioned on one side of the engaged side virtual line connecting a point at the engaged side holding part at which the engaged side belt is held together with the engaged side leading end part and a point at the engaged side support part before being moved, the engaged side operating part extends from the engaged side support part to the other side relative to the engaged side virtual line, and the engaged side biasing part generates biasing force in such a direction that the engaged side leading end part is moved toward the engaged side first bar.

In the buckle according to the embodiment of the present invention, the engaging side third bar is positioned on the engaging side second bar side of the engaging side holding part, the engaging side holding part is formed by a surface facing the engaging side third bar side, the engaged side third bar is positioned on the engaged side second bar side of the engaged side holding part, and the engaged side holding part is formed by a surface facing the engaged side third bar side.

In the buckle according to the embodiment of the present invention, the engaging side moving part is rotated about the engaging side support part, the engaging side leading end part is biased to the engaging side holding part from the engaging side third bar side, the engaged side moving part is rotated about the engaged side support part, and the engaged side leading end part is biased to the engaged side holding part from the engaged side third bar side.

In the buckle according to the embodiment of the present invention, the engaging side moving part has an engaging side extension part extending from the engaging side contacting part contacting the engaging side second bar in a direction away from the engaging side second bar, and the engaged side moving part has an engaged side extension part extending from the engaged side contacting part contacting the engaged side second bar in a direction away from the engaged side second bar.

The buckle according to the embodiment of the present invention further includes: an engaging side belt wound on the engaging side winding part of the engaging side first bar from one side of the engaging side virtual line to the other side thereof, passing the engaging side holding part between the engaging side first bar and the engaging side leading end part, and contacting the engaging side third bar on the one side of the engaging side virtual line; and an engaged side belt wound on the engaged side winding part of the engaged side first bar from one side of the engaged side virtual line to the other side thereof, passing the engaged side holding part between the engaged side first bar and the engaged side leading end part, and contacting the engaged side third bar on the one side of the engaged side virtual line.

According to the belt holding structure, engaging device, and buckle of one embodiment of the present invention, it is possible to prevent the belt from coming loose and thus to stably maintain a belt tightening state.

DESCRIPTION OF THE PREFERRED EMBODIMENTS

Hereinafter, a belt holding structure, an engaging member, an engaging device, and a buckle according to embodiments of the present invention will be described based on the drawings.

Figure 1:
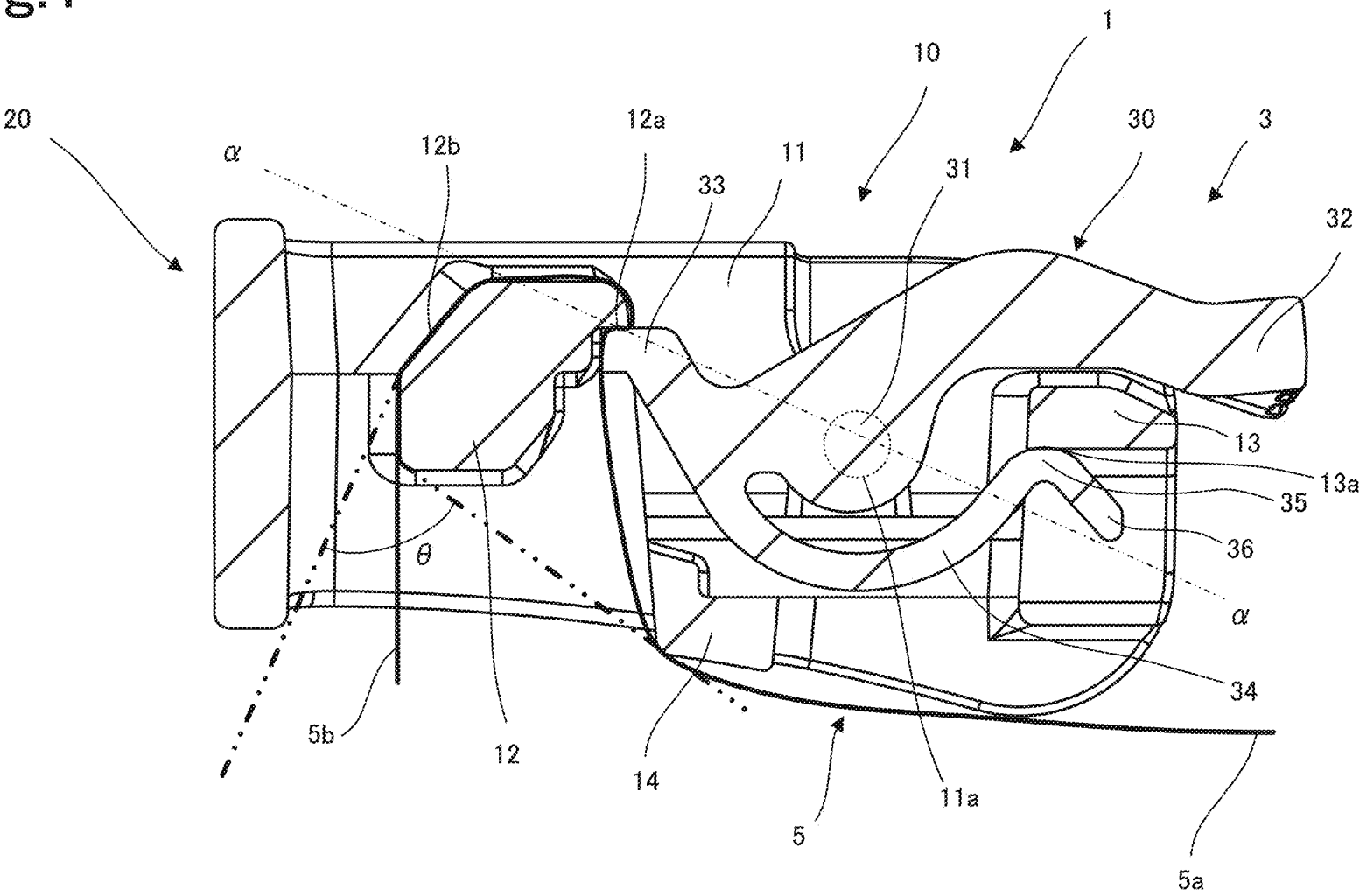
FIG. 1 illustrates a belt holding structure according to a first embodiment in a normal state.

FIG. 1 illustrates a belt holding structure 1 according to a first embodiment in a normal state.

The belt holding structure 1 has at least a base part 10 around which a belt 5 is wound, an engaging part 20 engageable with another member, and a moving part 30 movably attached to the base part 10.

The base part 10 has two wall parts 11 arranged spaced from each other, a first bar 12 installed between the two wall parts 11, a second bar 13 installed between the two wall parts 11 at a position further apart from the engaging part 20 than the first bar 12 is from the engaging part 20, and a third bar 14 installed between the two wall parts 11 at a position further apart from the engaging part 20 than the first bar 12 is from the engaging part 20 and closer to the engaging part 20 than the second bar 13 is to the engaging part 20.

The moving part 30 has a support part 31 relatively movably attached to the wall parts 11 of the base part 10, an operating part 32 extending from the support part 31, a leading end part 33 extending from the support part 31 toward the first bar 12, a biasing part 34 extending while being curved from the support part 31 toward the second bar 13, a contacting part 35 extending from the biasing part 34 and contacting, at least partially, the second bar 13, and an extension part 36 extending from the contacting part 35 in a direction away from the second bar 13.

The wall parts 11 have a fitting part 11*a* which is a pair of recessed holes each formed at a part of the inner surface thereof. The support part 31 of the moving part 30 is movably fitted to the fitting part IIa. The first bar 12 has a step-like holding part 12*a* formed at a part of the outer periphery thereof on the third bar 14 side and a winding part 12*b* formed at a part of the outer periphery thereof on the side opposite to the third bar 14 that extends from the engaging part 20 side to the holding part 12*a* and on which the belt 5 is wound. The second bar 13 has a planar pressing part 13*a* at least at a part of the outer periphery thereof. The planar pressing part 13*a* contacts the contacting part 35.

In a cross-section perpendicular to the extending direction of the support part 31, a line connecting a point at the holding part 12*a* of the first bar 12 contacting the leading end part 33 and a point at the support part 31 before being moved is assumed to be a virtual line α. The side of the virtual line α at which the third bar 14 exists is referred to as "one side", and its opposite side is referred to as "the other side".

The support part 31 is formed in a convex shape and is fitted in the fitting part 11*a* which is a recessed hole formed in each of the wall parts 11. In the first embodiment, the fitting part 11*a* is formed by a hole, and the support part 31 can be rotated in the hole. The operating part 32 extends from the support part 31 to the other side relative to the virtual line α. The leading end part 33 extends from the support part 31 toward the first bar 12. In a state where the belt is absent, the tip of the leading end part 33 contacts the holding part 12*a* of the first bar 12. The biasing part 34 extends while being curved from the support part 31 toward the second bar 13. The biasing part 34 has flexibility and generates biasing force when being curved. The contacting part 35 contacts, at least partially, the second bar 13 and receives reaction force from the second bar 13 to curve the biasing part 34. The extension part 36 extends from the contacting part 35 in such a direction that the tip end thereof is away from the second bar 13.

The base part 10, engaging part 20, and moving part 30 according to the present embodiment are all made of synthetic resin such as polyacetal, polyamide, or polypropylene. The above parts 10, 20, and 30 may be made of a metal material, considering mechanical strength.

A method of assembling the moving part 30 to the base part will be described.

Figure 2A:
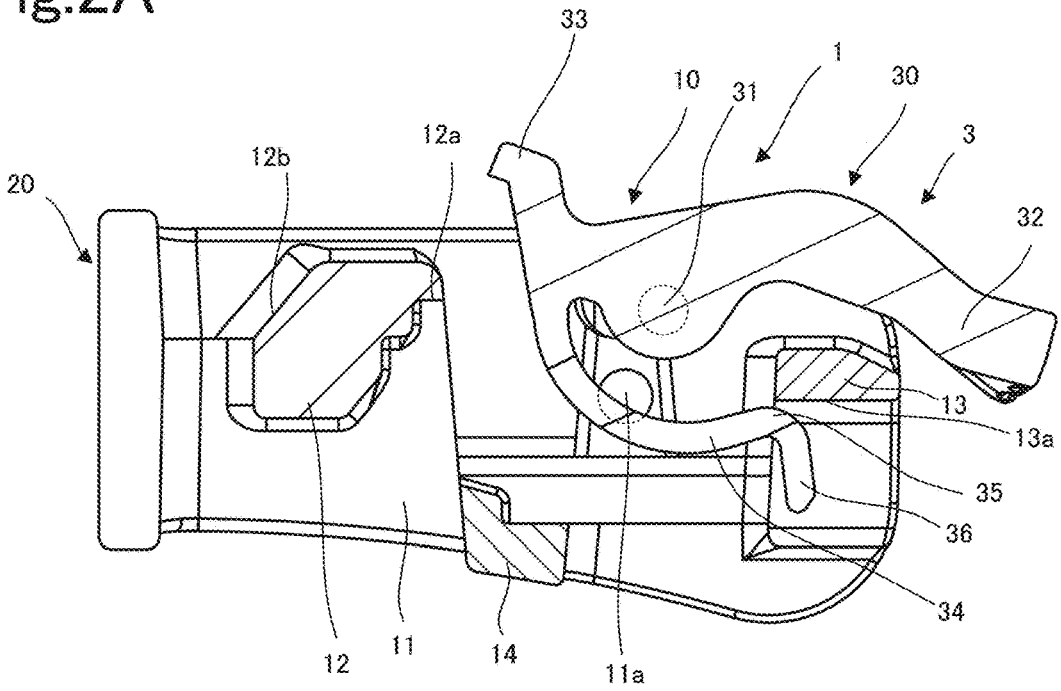
FIGS. 2A and 2B illustrate a mounting method of a moving part of the belt holding structure according to the first embodiment.
Figure 2B:
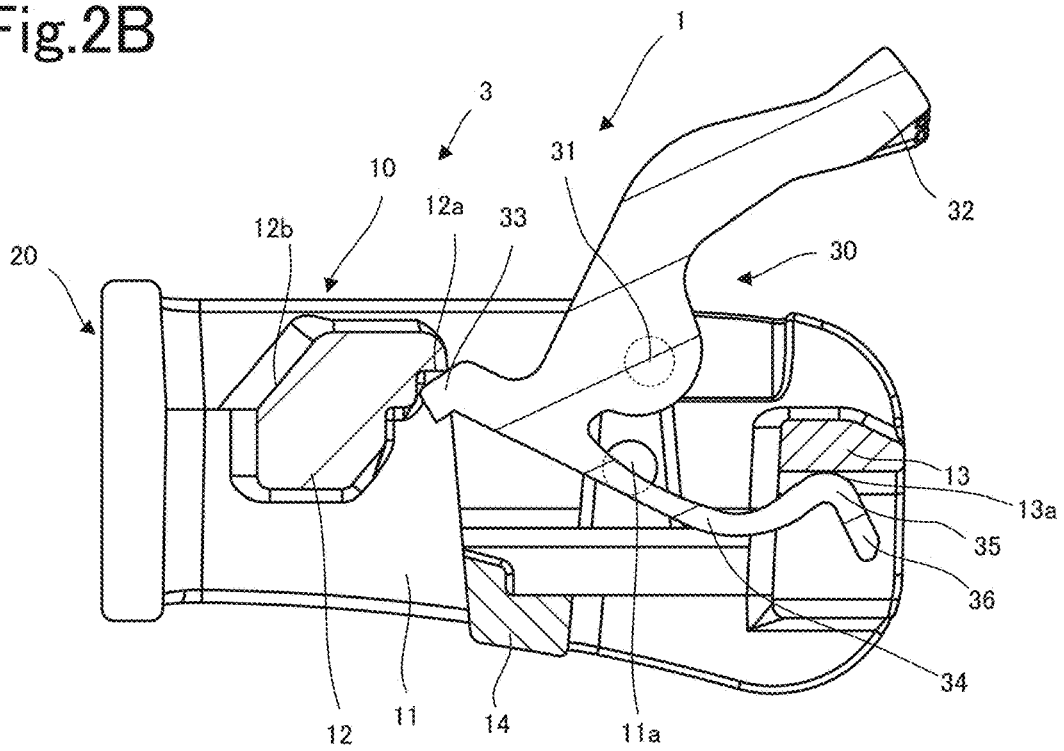

FIGS. 2A and 2B illustrate a mounting method of the moving part 30 of the belt holding structure 1 according to the first embodiment. FIG. 2A illustrates a state where the moving part 30 of the belt holding structure 1 according to the first embodiment is inserted between the both wall parts 11 of the base part 10. FIG. 2B illustrates a state where the contacting part 35 of the moving part 30 of the belt holding structure 1 according to the first embodiment is brought into contact with the pressing part 13*a* of the second bar 13 to hook the leading end part 33 to the holding part 12*a* of the first bar 12.

First, as illustrated in FIG. 2A, the moving part 30 is inserted between the both wall parts 11 of the base part 10 such that the second bar 13 is positioned between the operating part 32 and contacting part 35 of the moving part 30. In this state, the support part 31 is not yet fitted in the fitting part 11*a*. The extension part 36 extends in such a direction that the tip end thereof is away from the second bar 13, so that the contacting part 35 can be moved while being brought into contact with the second bar 13, allowing the extension part 36 to be easily inserted exceeding the third bar 14 side end of the second bar 13.

Subsequently, as illustrated in FIG. 2B, the operating part 32 is lifted in a direction away from the contacting part 35 of the moving part 30 in a state where the contacting part 35 is brought into contact with the pressing part 13*a* of the second bar 13 to hook the leading end part 33 on the holding part 12*a* of the first bar 12.

Finally, as illustrated in FIG. 1, the operating part 32 is lowered toward the second bar 13, and the support part 31 is fitted in the fitting part 11*a*.

As described above, in the belt holding structure 1 according to the first embodiment, the moving part 30 can be easily assembled to the base part 10 without use of a tool or the like. Particularly, since the biasing part 34 having flexibility is curved from the support part 31 toward the second bar 13, and the extension part 36 is bent in the direction opposite to the biasing part 34, the moving part 30 can be assembled to the base part 10 more easily.

To mount the belt 5 in the belt holding structure 1, the belt 5 is made to pass between the engaging part 20 and the first bar 12 from the one side of the virtual line α to the other side thereof. Subsequently, the belt 5 is wound on the winding part 12*b* of the first bar 12 and made to pass between the holding part 12*a* of the first bar 12 and the leading end part 33 from the other side to the one side. Then, a one end side 5*a* of the belt 5 is pulled to the side opposite to the engaging part 20 while the belt 5 is brought into contact with the third bar 14.

Figure 3:
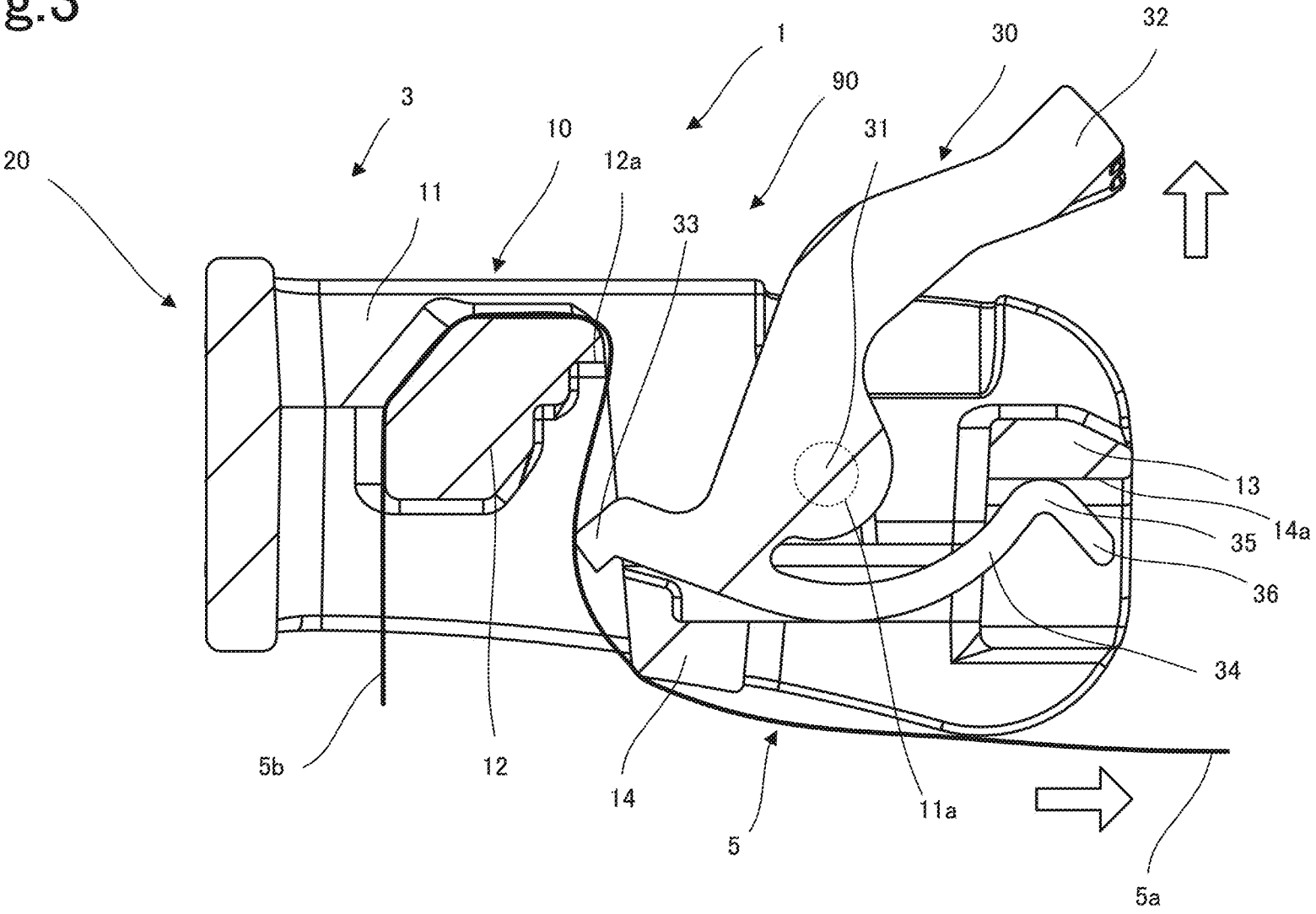
FIG. 3 illustrates the belt holding structure according to the first embodiment during adjustment.

FIG. 3 illustrates the belt holding structure 1 according to the present embodiment during adjustment.

To control the tightening degree of the belt 5 in the belt holding structure 1 according to the first embodiment, the operating part 32 is lifted in a direction away from the second bar 13, or the one end side 5*a* of the belt 5 is pulled.

When the operating part 32 is lifted in a direction away from the second bar 13 in the normal state, the moving part 30 rotates about the support part 31. The leading end part 33 moves in a direction away from the holding part 12*a* of the first bar 12. Then, a space is generated between the leading end part 33 and the holding part 12*a* of the first bar 12, allowing the belt 5 to be moved.

At this time, the biasing part 34 is deflected in a state where the contacting part 35 is brought into contact with the pressing part 13*a* of the second bar 13. Thus, biasing force is generated in the moving part 30 in such a direction that the leading end part 33 is brought into contact with the holding part 12*a*. Accordingly, when the force lifting the operating part 32 is reduced, the moving part 30 is moved in such a direction that the leading end part 33 is brought into contact with the holding part 12*a*.

When the one end side 5*a* of the belt 5 is pulled in the normal state, the leading end part 33 is pulled and moves to the third bar 14 side by friction force generated with the belt 5, and the moving part 30 rotates about the support part 31. Then, a space is generated between the leading end part 33 and the holding part 12*a* of the first bar 12, allowing the belt 5 to be moved.

At this time, the biasing part 34 is deflected in a state where the contacting part 35 is brought into contact with the pressing part 13*a* of the second bar 13. Thus, biasing force is generated in the moving part 30 in such a direction that the leading end part 33 is brought into contact with the holding part 12*a*. Accordingly, when the force pulling the one end side 5*a* of the belt 5 is reduced, the moving part 30 moves in such a direction that the leading end part 33 is brought into contact with the holding part 12*a*.

When the other end side 5*b* of the belt 5 is pulled in the state illustrated in FIG. 1 by some influence exerted during use, friction force is generated between the belt 5 and the first bar 12 since the other end side 5*b* of the belt 5 contacts the winding part 12*b* of the first bar 12. The force pulling the belt 5 to the other end side 5*b* does not give influence to a part of the belt 5 that is held between the holding part 12*a* of the first bar 12 and the leading end part 33, so that movement of the belt 5 is suppressed, preventing the belt 5 from coming loose. Thus, as denoted by the angle θ in FIG. 1, the direction of the other end side 5*b* of the belt 5 is allowed over a wide range, making it possible to stably hold the belt 5.

Figure 4:
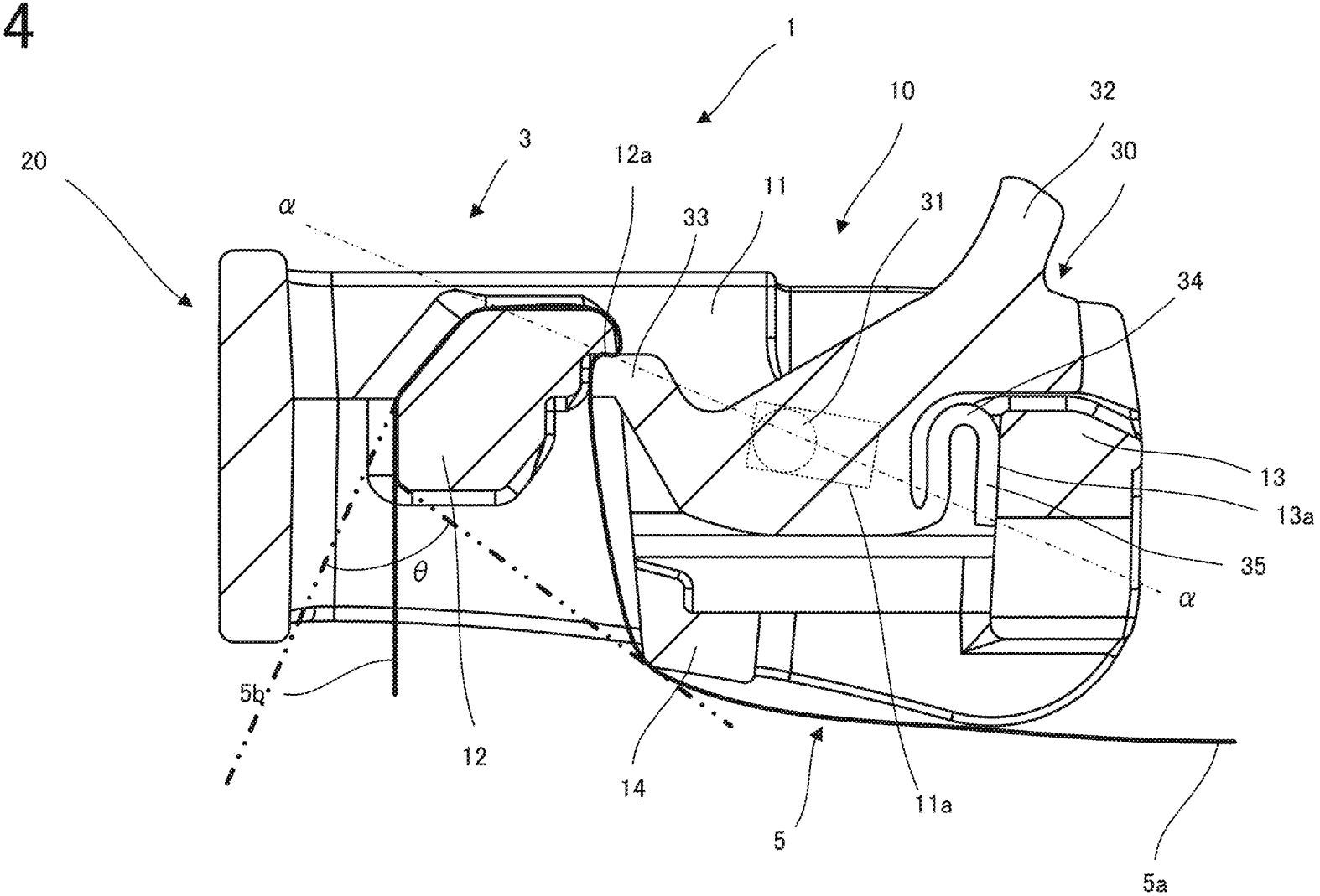
FIG. 4 illustrates a belt holding structure according to a second embodiment in a normal state.

FIG. 4 illustrates a belt holding structure 1 according to a second embodiment in a normal state.

In the belt holding structure 1 according to the second embodiment illustrated in FIG. 4, the wall parts 11 has the fitting part 11*a* which is a pair of recessed straight lines or curved lines, and the support part 31 is moved along the fitting part 11*a*. Other structures are the same as those of the belt holding structure 1 according to the first embodiment.

To control the tightening degree of the belt 5 in the belt holding structure 1 according to the second embodiment, the operating part 32 is lifted in a direction away from the first bar 12, or the one end side 5*a* of the belt 5 is pulled.

When the operating part 32 is moved in a direction away from the first bar 12 in the normal state, the support part 31 moves in the fitting part 11*a* to move the moving part 30. The leading end part 33 is moved in a direction away from the holding part 12*a* of the first bar 12. Then, a space is generated between the leading end part 33 and the holding part 12*a* of the first bar 12, allowing the belt 5 to be moved.

At this time, the biasing part 34 is deflected in a state where the contacting part 35 is brought into contact with the pressing part 13*a* of the second bar 13. Thus, biasing force is generated in the moving part 30 in such a direction that the leading end part 33 is brought into contact with the holding part 12*a*. Accordingly, when the force moving the operating part 32 is reduced, the moving part 30 moves in such a direction that the leading end part 33 is brought into contact with the holding part 12*a*.

When the other end side 5*b* of the belt 5 is pulled in the state illustrated in FIG. 4 by some influence exerted during use in the belt holding structure 1 according to the second embodiment, friction force is generated between the belt 5 and the first bar 12 since the other end side 5*b* of the belt 5 contacts the winding part 12*b* of the first bar 12. The force pulling the belt 5 to the other end side 5*b* does not give influence to a part of the belt 5 that is held between the holding part 12*a* of the first bar 12 and the leading end part 33, so that movement of the belt 5 is suppressed, preventing the belt 5 from coming loose. Thus, as denoted by the angle θ in FIG. 4, the direction of the other end side 5*b* of the belt 5 is allowed over a wide range, making it possible to stably hold the belt 5.

Figure 5:
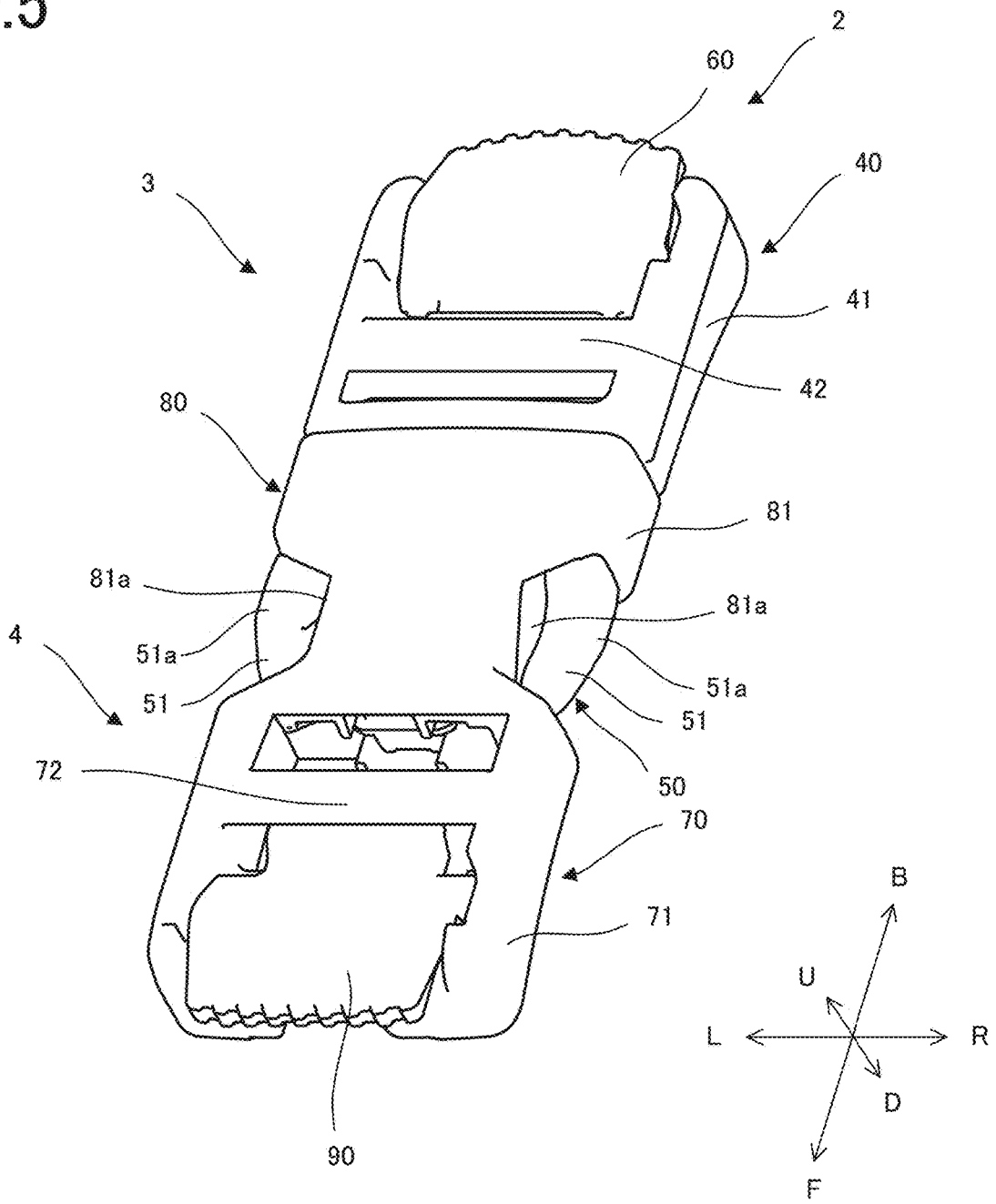
FIG. 5 is a perspective view of a buckle according to one embodiment of the present invention.
Figure 6:
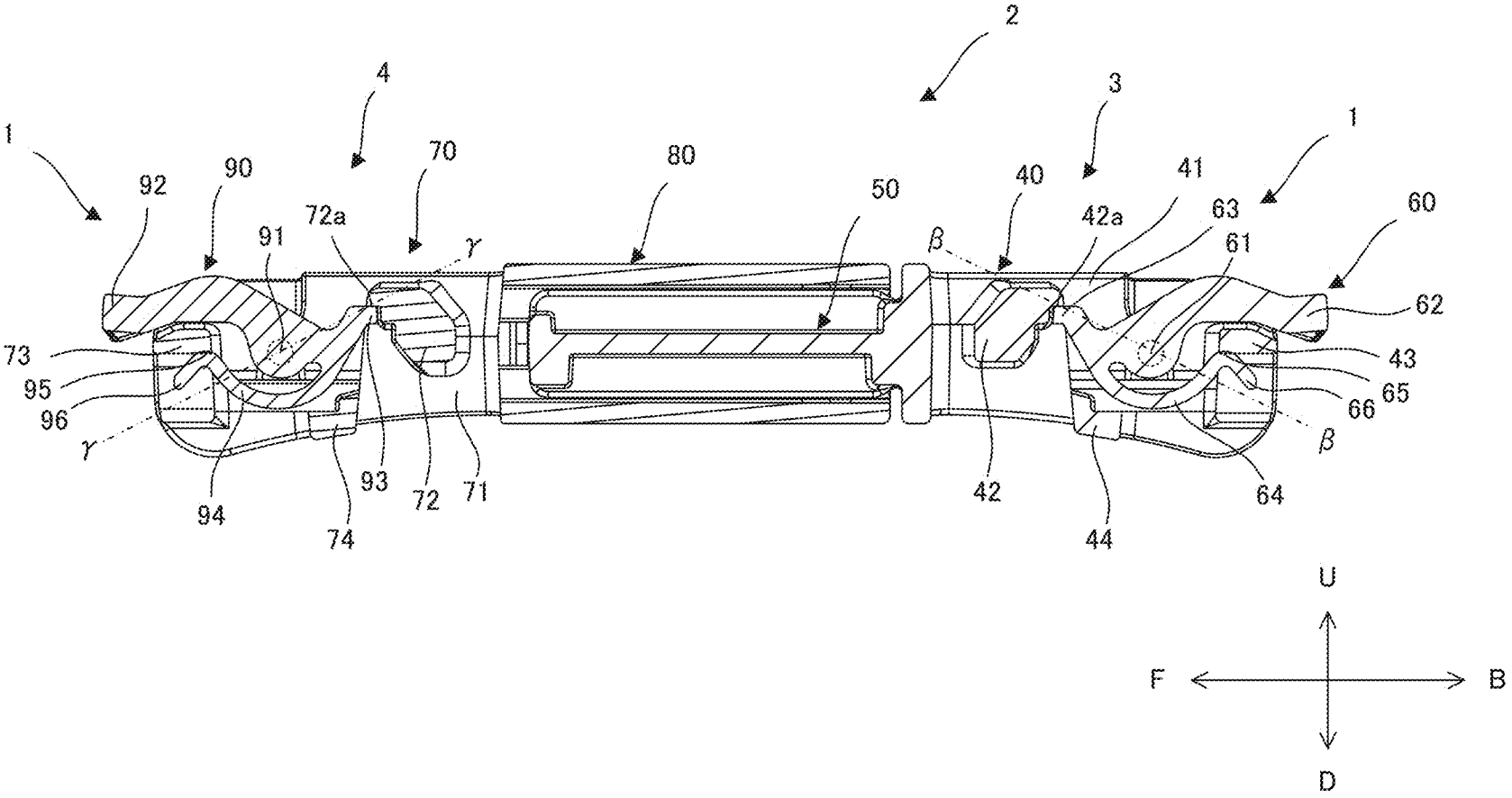
FIG. 6 is a cross-sectional view of the buckle according to the embodiment.

FIG. 5 is a perspective view of a buckle 2 according to one embodiment of the present invention. FIG. 6 is a cross-sectional view of the buckle 2 according to the embodiment.

The buckle 2 as an engaging device according to the present embodiment has a plug 3 (engaging member) using a leg part 51 as an engaging part 50 and a socket 4 (engaged member) using a fitting part 81 as an engaged part 80 engaged with the engaging part 50. Both the plug 3 and socket 4 use the belt holding structure 1 according to the first embodiment illustrated in FIG. 1. The leg part 51 and the fitting part 81 are referred to as "engaging part 50" and "engaged part 80", respectively, merely for descriptive convenience, so that the leg part 51 and the fitting part 81 may be referred to as "engaged part 80" and "engaging part 50", respectively. Further, the engaging part 50 and the engaged part 80 may be realized by structures other than the leg part 51 and the fitting part 81, respectively. For example, the engaging part 50 may be realized by a convex-shaped part such as a hook or a button, and the engaged part 80 may be realized by a recessed part such as a hole.

The plug 3 of the buckle 2 according to the present embodiment includes an engaging side base part 40 having two engaging side wall parts 41 arranged spaced from each other, an engaging side first bar 42 provided so as to extend over the two engaging side wall parts 41, an engaging side second bar 43 provided so as to be separated from the engaging side first bar 42 and to extend over the two engaging side wall parts 41, and an engaging side third bar 44 provided so as to be separated from the engaging side first bar 42 and engaging side second bar 43 and to extend over the two engaging side wall parts 41.

The plug 3 further includes an engaging side moving part 60 having a leg part 51 extending to the side opposite to the engaging side first bar 42 from the end portion of the engaging side base part 40 on the side closer to the engaging side first bar 42, an engaging side support part 61 relatively movably attached to the engaging side wall parts 41, an engaging side operating part 62 extending from the engaging side support part 61, an engaging side leading end part 63 extending from the engaging side support part 61 toward the engaging side first bar 42, an engaging side biasing part 64 extending while being curved from the engaging side support part 61 toward the engaging side second bar 43, an engaging side contacting part 65 extending from the engaging side biasing part 64 and contacting, at least partially, the engaging side second bar 43, and an engaging side extension part 66 extending from the engaging side contacting part 65 in a direction away from the engaging side second bar 43.

Further, in a cross-section perpendicular to the extending direction of the engaging side support part 61 of the plug 3, the engaging side first bar 42 includes an engaging side holding part 42*a* that holds an engaging side belt 5 together with the engaging side leading end part 63 and an engaging side winding part 42*b* on which the engaging side belt 5 is wound, the engaging side third bar 44 is positioned on one side of an engaging side virtual line β connecting a point at the engaging side holding part 42*a* at which the engaging side belt 5 is held together with the engaging side leading end part 63 and a point at the engaging side support part 61 before being moved, the engaging side operating part 62 extends from the engaging side support part 61 to the other side relative to the engaging side virtual line β, and the engaging side biasing part 64 generates biasing force in such a direction that the engaging side leading end part 63 moves toward the engaging side first bar 42. The engaging side contacting part 65 contacts, at least partially, the engaging side second bar 43 and receives reaction force from the engaging side second bar 43 to curve the engaging side biasing part 64. The engaging side extension part 66 extends from the engaging side contacting part 65 in such a direction that the tip end thereof is away from the engaging side second bar 43. A method of assembling the engaging side moving part 60 to the engaging side base part 40 is the same as the mounting method of the moving part 30 of the belt holding structure 1 according to the first embodiment illustrated in FIG. 2, so description thereof will be omitted.

The socket 4 of the buckle 2 according to the present embodiment includes an engaged side base part 70 having two engaged side wall parts 71 arranged spaced from each other, an engaged side first bar 72 provided so as to extend over the two engaged side wall parts 71, an engaged side second bar 73 provided so as to be separated from the engaged side first bar 72 and to extend over the two engaged side wall parts 71, and an engaged side third bar 74 provided so as to be separated from the engaged side first bar 72 and engaged side second bar 73 and to extend over the two engaged side wall parts 71.

The socket 4 further includes an engaged side moving part 90 having a fitting part 81 extending to the side opposite to the engaged side first bar 72 from the end portion of the engaged side base part 70 on the side closer to the engaged side first bar 72, an engaged side support part 91 relatively movably attached to the engaged side wall parts 71, an engaged side operating part 92 extending from the engaged side support part 91, an engaged side leading end part 93 extending from the engaged side support part 91 toward the engaged side first bar 72, an engaged side biasing part 94 extending while being curved from the engaged side support part 91 toward the engaged side second bar 73, an engaged side contacting part 95 extending from the engaged side biasing part 94 and contacting, at least partially, the engaged side second bar 73, and an engaged side extension part 96 extending from the engaged side contacting part 95 in a direction away from the engaged side second bar 73.

Further, in a cross-section perpendicular to the extending direction of the engaged side support part 91 of the socket 4, the engaged side first bar 72 includes an engaged side holding part 72*a* that holds an engaged side belt 7 together with the engaged side leading end part 93 and an engaged side winding part 72*b* on which the engaged side belt 7 is wound, the engaged side third bar 74 is positioned on one side of an engaged side virtual line γ connecting a point at the engaged side holding part 72*a* at which the engaged side belt 7 is held together with the engaged side leading end part 93 and a point at the engaged side support part 91 before being moved, the engaged side operating part 92 extends from the engaged side support part 91 to the other side relative to the engaged side virtual line γ, and the engaged side biasing part 94 generates biasing force in such a direction that the engaged side leading end part 93 is moved toward the engaged side first bar 72. The engaged side contacting part 95 contacts, at least partially, the engaged side second bar 73 and receives reaction force from the engaged side second bar 73 to curving the engaged side biasing part 94. The engaged side extension part 96 extends from the engaged side contacting part 95 in such a direction that the tip end thereof is away from the engaged side second bar 73. A method of assembling the engaged side moving part 90 to the engaged side base part 70 is the same as the mounting method of the moving part 30 of the belt holding structure 1 according to the first embodiment illustrated in FIG. 2, so description thereof will be omitted.

Hereinafter, a direction in which the plug 3 is inserted or removed into/from the socket 4 is referred to as "front-back direction F-B", a direction in which the plug 3 is inserted into the socket 4 is referred to as "front direction F", and a direction in which the plug 3 in a connected state is removed from the socket 4 is referred to as "back direction B". Further, a direction in which a pair of leg parts 21 of the plug 3 are opposed to each other is referred to as "left-right direction L-R", and a direction perpendicular to the left-right direction L-R and front-back direction F-B is referred to as "up-down direction U-D" or "thickness direction".

As illustrated in FIG. 5, the buckle 2 has the plug 3 and socket 4 in which the plug 3 is fitted and locked. The plug 3 and socket 4 are each attached to one of paired members (belt, tape, or the like) and allow the members to be connected or detached to/from each other as desired.

The plug 3 is integrally formed using synthetic resin such as polyacetal, polyamide, or polypropylene. The plug 3 has the engaging side base part 40 into which a predetermined member such as a tape or a belt is inserted for connection, the engaging part 50 formed in the engaging side base part 40, and the engaging side moving part 60 movably attached to the engaging side base part 40.

The socket 4 is also integrally formed using synthetic resin such as polyacetal, polyamide, or polypropylene. The socket 4 has the engaged side base part 70 into which a predetermined member such as a tape or a belt is inserted for connection, the engaged part 80 engaged with the engaging part 50 of the plug 3, and the engaged side moving part 90 movably attached to the engaged side base part 70.

The engaging part 50 of the plug 3 is constituted of a pair of leg parts 51, and the engaged part 80 of the socket 4 is constituted of a fitting part 81 in which the leg parts 51 are fitted. A mechanism formed by the leg parts 51 and fitting part 81 may be the same as that of a general buckle. For example, the pair of leg parts 51 of the plug 3 protrude symmetrically from the end portions of the engaging side base part 40 and each have a bulging part 51*a* bulging outward in the left-right direction at the center thereof in the protruding direction. The fitting part 81 of the socket 4 protrudes from the engaged side base part 70, and the upper and lower surfaces thereof face each other with a predetermined interval therebetween to form a space for inserting the leg parts 51 of the plug 3. The fitting part 81 has a hole 81*a* engaged with each leg part 51. When the leg part 51 is inserted into the hole 81*a* according to the present embodiment, the bulging part 51*a* of the leg part 51 protrudes from the hole 81*a*.

When being pressed inward, the bulging parts 51*a* bulging to the outside of the respective leg parts 51 approach each other from both sides while being deflected. By inserting the leg parts 51 into the fitting part 81 in this state, the plug 3 is inserted into the socket 4 while the outer surfaces of the respective leg parts 51 contacting the inner surface of the fitting part 81. When the plug 3 is further pushed in, the bulging parts 51*a* of the leg parts 51 face the respective holes 81*a* of the fitting part 81, the deflected leg parts 51 return to their original state, and the bulging parts 51*a* and holes 81*a* are engaged with each other.

To release the engagement between the plug 3 and socket 4, the bulging part 51*a* of the leg part 51 is pressed inward for removal from the hole 81*a* of the fitting part 81. In this state, the plug 3 and the socket 4 are relatively moved in such a direction that they are away from each other. Thereafter, when the hand of a user is released from the leg parts 51, the plug 3 is pushed out from the engaging position along the inner surface of the fitting part 81 by the flexibility of the leg part 51 and, hence, is separated from the socket 4.

Figure 7:
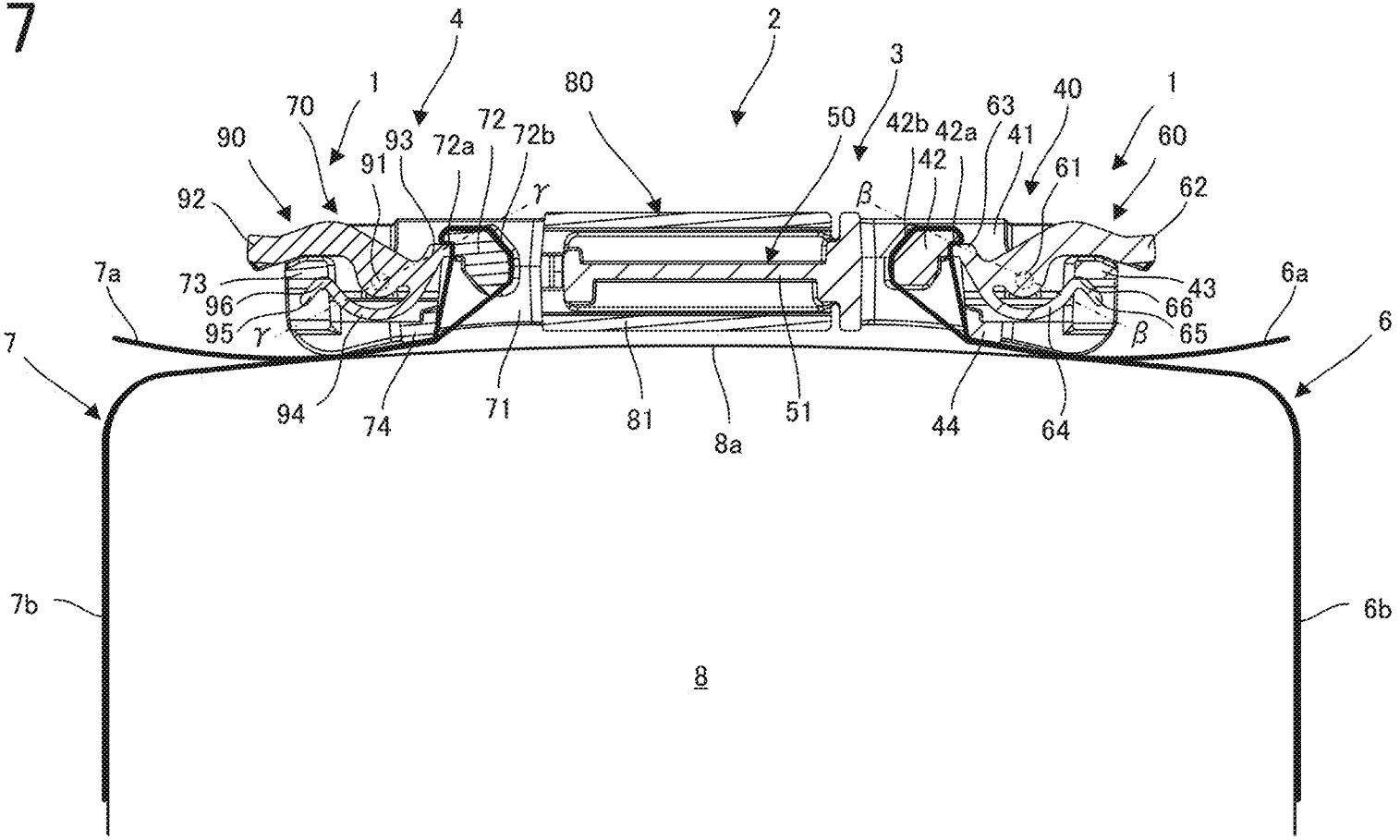
FIG. 7 illustrates an example in which the buckle according to the present embodiment is used along one surface of a predetermined object.

FIG. 7 illustrates an example in which the buckle 2 according to the present embodiment is used along one surface 8*a* of a predetermined object 8.

In this example, the other end side 6*b* of the engaging side belt 6 and the other end side 7*b* of the engaged side belt 7 are mounted to the object 8 or another object that supports the object 8. The engaging side belt 6 and engaged side belt 7 may be constituted by a single belt. In this case, the one end side 6*a* of the engaging side belt 6 is one end side of the single belt, and the one end side 7*a* of the engaged side belt 7 is the other end side of the single belt.

As illustrated in FIG. 7, in the buckle 2 in which the plug 3 and socket 4 are engaged with each other, when at least one of the one end side 6*a* of the engaging side belt 6 and one end side 7*a* of the engaged side belt 7 is pulled, the engaging side belt 6 or engaged side belt 7 is tightened to hold the object 8. At this time, the engaging side belt 6 contacts the engaging side third bar 44 at a point closer to the one end side 6*a* than the engaging side leading end part 63 of the engaging side moving part 60 and contacts the engaging side first bar 42 at a point closer to the other end side 6*b* than the engaging side leading end part 33. The same action is performed in the engaged side belt 7, so description of the action in the engaged side belt 7 will be omitted.

To tighten the engaging side belt 6 in the state illustrated in FIG. 7, the one end side 6*a* of the engaging side belt 6 is pulled. That is, when the one end side 6*a* of the engaging side belt 6 is pulled, the engaging side leading end part 63 of the engaging side moving part 60 that holds the engaging side belt 6 together with the engaging side first bar 42 is pulled, causing the engaging side moving part 60 to be rotated about the engaging side support part 61, with the result that the engaging side leading end part 63 is separated from the engaging side first bar 42. The separation of the engaging side leading end part 63 from the engaging side first bar 42 allows the engaging side belt 6 to move, with the result that the engaging side belt 6 moves to the one end side 6*a* side.

To loosen the engaging side belt 6, the engaging side operating part 62 of the engaging side moving part 60 is lifted. That is, when the engaging side operating part 62 is lifted, the engaging side moving part 60 rotates about the engaging side support part 61, with the result that the engaging side leading end part 63 is separated from the engaging side first bar 42. The separation of the engaging side leading end part 63 from the engaging side first bar 42 allows the engaging side belt 6 to move. Since the engaging side belt 6 is not pulled to the one end side 6*a*, it can move to the other end side 6*b*.

When the other end side 6*b* of the engaging side belt 6 is pulled in the state illustrated in FIG. 7, friction force is generated between the engaging side belt 6 and the engaging side first bar 42 since the other end side 6*b* of the engaging side belt 6 contacts the engaging side first bar 42. Further, when the other end side 6*b* of the engaging side belt 6 is pulled, the engaging side leading end part 63 is pulled upward by the engaging side belt 6, so that the engaging side belt 6 is securely held between the engaging side first bar 42 and the engaging side leading end part 63. Thus, movement of the engaging side belt 6 is suppressed, whereby the object 8 is held reliably.

Figure 8:
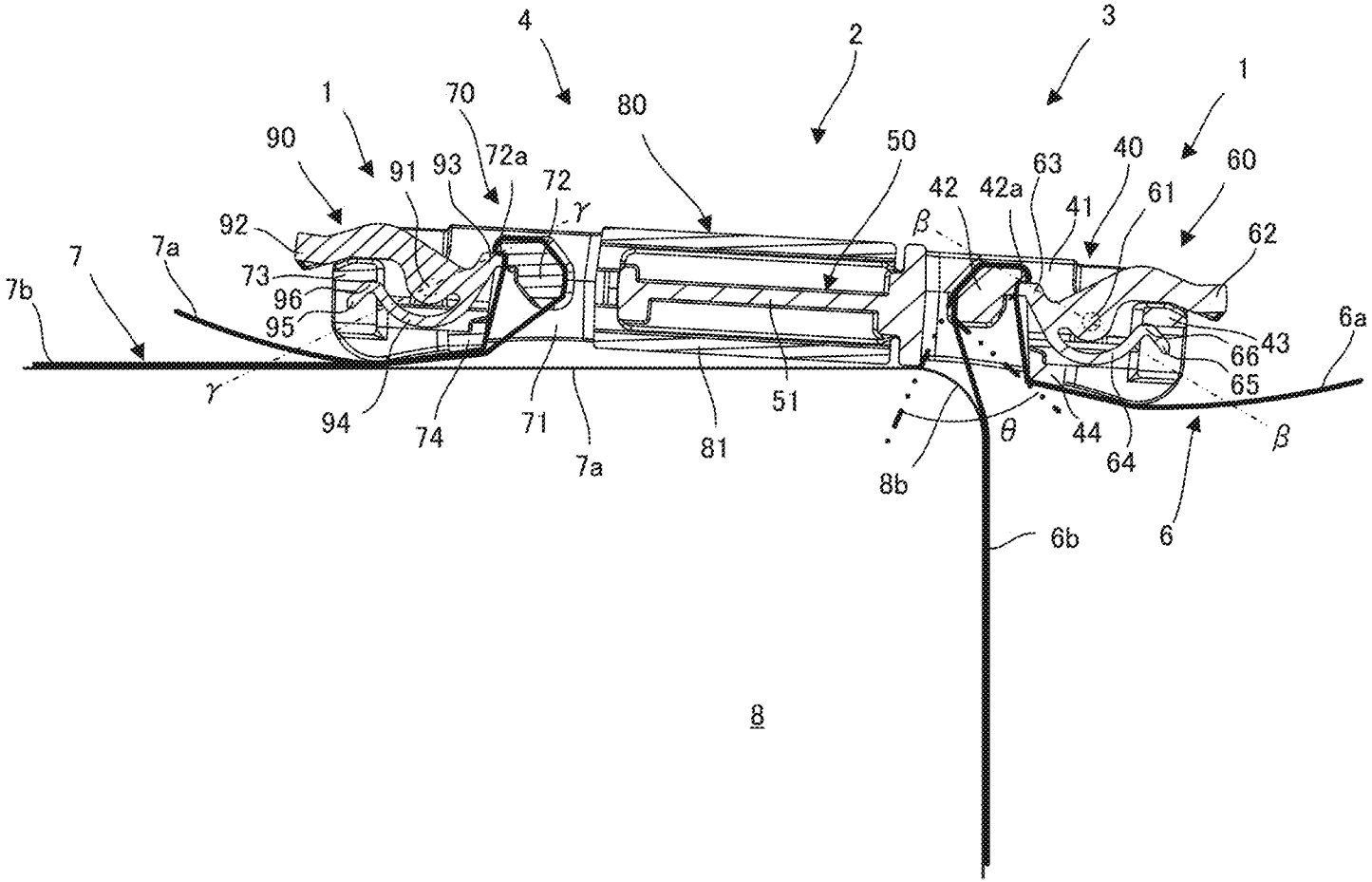
FIG. 8 illustrates an example in which the buckle according to the present embodiment is positioned at a corner of a predetermined target.

FIG. 8 illustrates an example in which the buckle 2 according to the present embodiment is positioned at a corner 8*b* of a predetermined target 8.

When a target 8 to be carried is fastened with the buckle 2, there may occur a case where the plug 3 of the buckle 2 is positioned at the corner 8*b* of the object 8, and the engaging side base part 40 of the plug 3 is separated from the object 8, as illustrated in FIG. 8.

To tighten the engaging side belt 6 in the state illustrated in FIG. 8, the one end side 6*a* of the engaging side belt 6 is pulled. That is, when the one end side 6*a* of the engaging side belt 6 is pulled, the engaging side leading end part 63 of the engaging side moving part 60 that holds the engaging side belt 6 together with the engaging side first bar 42 is pulled, causing the engaging side moving part 60 to rotate about the engaging side support part 61, with the result that the engaging side leading end part 63 is separated from the engaging side first bar 42. The separation of the engaging side leading end part 63 from the engaging side first bar 42 allows the engaging side belt 6 to move, with the result that the engaging side belt 6 moves to the one end side 6*a*.

To loosen the engaging side belt 6, the engaging side operating part 62 of the engaging side moving part 60 is lifted. That is, when the engaging side operating part 62 is lifted, the engaging side moving part 60 rotates about the engaging side support part 61, with the result that the engaging side leading end part 63 is separated from the engaging side first bar 42. The separation of the engaging side leading end part 63 from the engaging side first bar 42 allows the engaging side belt 6 to move. Since the engaging side belt 6 is not pulled to the one end side 6*a*, it can be moved to the other end side 6*b*.

When the other end side 6*b* of the engaging side belt 6 is pulled in the state illustrated in FIG. 8, friction force is generated between the engaging side belt 6 and the engaging side first bar 42 since the other end side 6*b* of the engaging side belt 6 contacts the engaging side first bar 42. Further, when the other end side 6*b* of the engaging side belt 6 is pulled, the engaging side leading end part 63 is pulled upward by the engaging side belt 6, so that the engaging side belt 6 is securely held between the engaging side first bar 42 and the engaging side leading end part 63. Thus, movement of the engaging side belt 6 is suppressed, whereby the object 8 can be maintained in a stable state.

Figure 9:
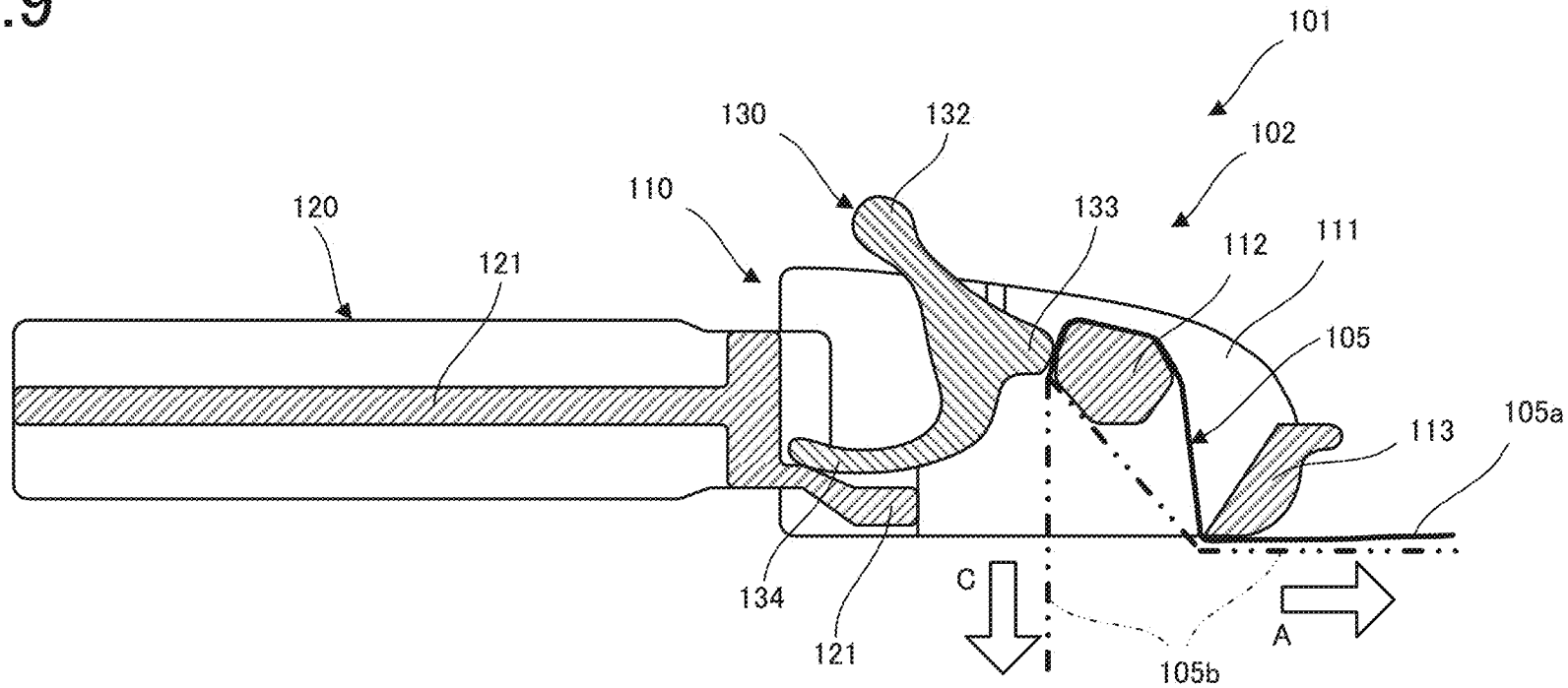
FIG. 9 illustrates the outline of a belt holding structure of a conventional buckle.

As described above, in the conventional buckle 101 illustrated in FIG. 9, when the other side 105*b* of the belt 105 is pulled in the second direction C, the belt 105 does not contact the base part 110 of the plug 102 on the other side 105*b* from the position at which it is held between the leading end part 133 and the first bar 112, so that the buckle 101 is in an unstable state.

On the other hand, in the buckle 2 according to the present embodiment, since the other end side 6*b* of the engaging side belt 6 contacts the engaging side first bar 42, so that when the other end side 6*b* of the engaging side belt 6 is pulled, even if the engaging side moving part 60 slightly rotates for some reason to cause the engaging side belt 6 to come off from between the engaging side leading end part 63 and engaging side first bar 42, the object 8 can be maintained in a stable state by friction between the engaging side belt 6 and the engaging side first bar 42. Thus, as denoted by the angle θ of FIG. 7, the direction of the other end side 6*b* of the engaging side belt 6 is allowed over a wide range, making it possible to stably hold the engaging side belt 6.

As described above, the belt holding structure 1 according to the present embodiment includes: the base part 10 (40, 70) having the two wall parts 11 (41, 71) arranged spaced from each other, the first bar 12 (42, 72) disposed so as to extend over the two wall parts 11 (41, 71), the second bar 13 (43, 73) disposed so as to be separated from the first bar 12 (42, 72) and to extend over the two wall parts 11 (41, 71), and the third bar 14 (44, 74) disposed so as to be separated from the first bar 12 (42, 72) and second bar 13 (43, 73) and to extend over the two wall parts 11 (41, 71); and the moving part 30 (60, 90) having the support part 31 (61, 91) relatively movably attached to the wall parts 11 (41, 71), the operating part 32 (62, 92) extending from the support part 31 (61, 91), the leading end part 33 (63, 93) extending from the support part 31 (61, 91) toward the first bar 12 (42, 72), the biasing part 34 (64, 94) extending while being curved from the support part 31 (61, 91) toward the second bar 13 (43, 73), and the contacting part 35 (65, 95) extending from the biasing part 34 (64, 94) and contacting, at least partially, the second bar 13 (43, 73). In a cross-section perpendicular to the extending direction of the support part 31 (61, 91), the first bar 12 (42, 72) has the holding part 12*a* (42*a*, 72*a*) that holds the belt 5 (6, 7) together with the leading end part 33 (63, 93) and the winding part 12*b* (42*b*, 72*b*) on which the belt 5 (6, 7) is wound, the third bar 14 (44, 74) is positioned on one side of the virtual line α (β, γ) connecting a point at the holding part 12*a* (42*a*, 72*a*) at which the belt 5 (6, 7) is held together with the leading end part 33 (63, 93) and a point at the support part 31 (61, 91) before being moved, the operating part 32 (62, 92) extends from the support part 31 (61, 91) to the other side relative to the virtual line α (β, γ), and the biasing part 34 (64, 94) generates biasing force in such a direction that the leading end part 33 (63, 93) is moved toward the first bar 12 (42, 72).

With the above configuration, the moving part 30 (60, 90) can be smoothly moved, and thus, the tension level of the belt 5 (6, 7) can be appropriately controlled. Further, the belt 5 (6, 7) can be held between the leading end part 33 (63, 93) of the moving part 30 (60, 90) and holding part 12*a* (42*a*, 72*a*) of the first bar 12 (42, 72), the one end side 5*a* (6*a*, 7*a*) of the belt 5 (6, 7) with respect to the holding part 12*a* (42*a*, 72*a*) contacts the third bar 14 (44, 74), and the other end side 5*b* (6*b*, 7*b*) of the belt 5 (6, 7) with respect to the holding part 12*a* (42*a*, 72*a*) is wound on the winding part 12*b* (42*b*, 72*b*) of the first bar 12 (42, 72), so that it is possible to prevent the belt 5 (6, 7) from coming loose and to stably maintain a belt tightening state.

Further, in the belt holding structure 1 according to the present embodiment, the third bar 14 (44, 74) is positioned on the second bar 13 (43, 73) side of the holding part 12*a* (42*a*, 72*a*), and the holding part 12*a* (42*a*, 72*a*) is formed by a surface facing the third bar 14 (44, 74) side. Thus, the third bar 14 (44, 74) is positioned in a direction in which the one end side 5*a* (6*a*, 7*a*) of the belt 5 (6, 7) is pulled, allowing the belt 5 (6, 7) to be smoothly pulled.

Further, in the belt holding structure 1 according to the present embodiment, the moving part 30 (60, 90) can be rotated about the support part 31 (61, 91), and the leading end part 33 (63, 93) is biased to the holding part 12*a* (42*a*, 72*a*) from the third bar 14 (44, 74) side.

Thus, to tighten the belt 5 (6, 7), the one end side 5*a* (6*a*, 7*a*) of the belt 5 (6, 7) is pulled to rotate the moving part 30 (60, 90) to thereby release holding of the belt 5 (6, 7) between the leading end part 33 (63, 93) and the holding part 12*a* (42*a*, 72*a*), thus allowing the belt 5 (6, 7) to be pulled. When the belt 5 (6, 7) may be loosened, the leading end part 33 (63, 93) is strongly pressed against the holding part 12*a* (42*a*, 72*a*), thereby preventing the belt 5 (6, 7) from coming loose, which can maintain a belt tightening state more stably.

Further, in the belt holding structure 1 according to the present embodiment, the moving part 30 (60, 90) has the extension part 36 (66, 96) extending from the contacting part 35 (65, 95) contacting the second bar 13 (43, 73) in a direction away from the second bar 13 (43, 73). Thus, in the belt holding structure 1, the moving part 30 (60, 90) can be easily assembled to the base part 10 (40, 70) without use of a tool or the like. Particularly, since the biasing part 34 (64, 94) having flexibility is curved from the support part 31 (61, 91) toward the second bar 13 (43, 73), and the extension part 36 (66, 96) is bent in the direction opposite to the biasing part 34 (64, 94), the moving part 30 (60, 90) can be assembled to the base part 10 (40, 70) more easily.

Further, the engaging member 3 according to the present embodiment includes the belt holding structure 1 and the engaging part 20 (50) provided at the end portion of the base part 10 (40) on the side closer to the first bar 12 (42) and engaged with another member. Thus, the engaging member 3 can be engaged with another member to allow the another member to hold an object.

Further, the engaging member 3 according to the present embodiment includes the belt 5 (6) wound on the first bar 12 (42) between the engaging part 20 (50) and the first bar 12 (42) from one side of the virtual line α (13) to the other side thereof, passing the holding part 12*a* (42*a*) between the first bar 12 (42) and the leading end part 33 (63) from the other side of the virtual line α (β) to the one side thereof, and contacting the third bar 14 (44) on the one side of the virtual line α (13). Thus, an object can be held by the belt 5 (6).

Further, the engaging device 2 according to the present embodiment includes the engaging member 3 and the engaged member 4 having the engaged part 80 detachably engaged with the belt holding structure 1 and the engaging part 50 of the engaging member 3. Thus, the engaging device 2 can detachably hold an object.

Further, in the engaging device 2 according to the present embodiment, the engaged member 4 includes the belt 7 wound on the first bar 72 between the engaged part 80 and the first bar 72 of the belt holding structure 1 from one side of the virtual line γ to the other side thereof, passing the holding part 72*a* between the first bar 72 and the leading end part 93, and contacting the third bar 74 on the one side of the virtual line γ. Thus, an object can be detachably held by the belt 7.

Further, the buckle 2 according to the present embodiment includes the plug 3 and socket 4. The plug 3 includes: the engaging side base part 40 having the two engaging side wall parts 41 arranged spaced from each other, the engaging side first bar 42 provided so as to extend over the two engaging side wall parts 41, the engaging side second bar 43 provided so as to be separated from the engaging side first bar 42 and to extend over the two engaging side wall parts 41, and the engaging side third bar 44 provided so as to be separated from the engaging side first bar 42 and engaging side second bar 43 and to extend over the two engaging side wall parts 41; and the engaging side moving part 60 having the leg part 51 extending to the side opposite to the engaging side first bar 42 from the end portion of the engaging side base part 40 on the side closer to the engaging side first bar 42, the engaging side support part 61 relatively movably attached to the engaging side wall parts 41, the engaging side operating part 62 extending from the engaging side support part 61, the engaging side leading end part 63 extending from the engaging side support part 61 toward the engaging side first bar 42, the engaging side biasing part 64 extending while being curved from the engaging side support part 61 toward the engaging side second bar 43, engaging side contacting part 65 extending from the engaging side biasing part 64 and contacting, at least partially, the engaging side second bar 43, wherein in a cross-section perpendicular to the extending direction of the engaging side support part 61, the engaging side first bar 42 includes the engaging side holding part 42*a* that holds the engaging side belt 5 together with the engaging side leading end part 63 and the engaging side winding part 42*b* on which the engaging side belt 5 is wound, the engaging side third bar 44 is positioned on one side of the engaging side virtual line β connecting a point at the engaging side holding part 42*a* at which the engaging side belt 5 is held together with the engaging side leading end part 63 and a point at the engaging side support part 61 before being moved, the engaging side operating part 62 extends from the engaging side support part 61 to the other side relative to the engaging side virtual line β, and the engaging side biasing part 64 generates biasing force in such a direction that the engaging side leading end part 63 is moved toward the engaging side first bar 42. The socket 4 includes the engaged side base part 70 having two engaged side wall parts 71 arranged spaced from each other, the engaged side first bar 72 provided so as to extend over the two engaged side wall parts 71, the engaged side second bar 73 provided so as to be separated from the engaged side first bar 72 and to extend over the two engaged side wall parts 71, and the engaged side third bar 74 provided so as to be separated from the engaged side first bar 72 and engaged side second bar 73 and to extend over the two engaged side wall parts 71; and engaged side moving part 90 having the fitting part 81 extending to the side opposite to the engaged side first bar 72 from the end portion of the engaged side base part 70 on the side closer to the engaged side first bar 72, the engaged side support part 91 relatively movably attached to the engaged side wall parts 71, the engaged side operating part 92 extending from the engaged side support part 91, the engaged side leading end part 93 extending from the engaged side support part 91 toward the engaged side first bar 72, the engaged side biasing part 94 extending while being curved from the engaged side support part 91 toward the engaged side second bar 73, and the engaged side contacting part 95 extending from the engaged side biasing part 94 and contacting, at least partially, the engaged side second bar 73, wherein in a cross-section perpendicular to the extending direction of the engaged side support part 91, the engaged side first bar 72 includes the engaged side holding part 72*a* that holds the engaged side belt 7 together with the engaged side leading end part 93 and the engaged side winding part 72*b* on which the engaged side belt 7 is wound, the engaged side third bar 74 is positioned on one side of the engaged side virtual line γ connecting a point at the engaged side holding part 72*a* at which the engaged side belt 7 is held together with the engaged side leading end part 93 and a point at the engaged side support part 91 before being moved, the engaged side operating part 92 extends from the engaged side support part 91 to the other side relative to the engaged side virtual line γ, and the engaged side biasing part 94 generates biasing force in such a direction that the engaged side leading end part 93 is moved toward the engaged side first bar 72.

With the above configuration, the moving part 60 (90) can be smoothly moved, and thus, the tension level of the belt 6 (7) can be appropriately controlled. Further, the belt 6 (7) can be held between the leading end part 63 (93) of the moving part 60 (90) and the holding part 42*a* (72*a*) of the first bar 42 (72), the one end side 6*a* (7*a*) of the belt 6 (7) with respect to the holding part 42*a* (72*a*) contacts the third bar 44 (74), and the other end side 6*b* (7*b*) of the belt 6 (7) with respect to the holding part 42*a* (72*a*) is wound on the winding part 42*b* (72*b*) of the first bar 42 (72), so that it is possible to prevent the belt 6 (7) from coming loose and to stably maintain a belt tightening state.

Further, in the buckle 2 according to the present embodiment, the engaging side third bar 44 is positioned on the engaging side second bar 43 side of the engaging side holding part 42*a*, and the engaging side holding part 42*a* is formed by a surface facing the engaging side third bar 44 side. The engaged side third bar 74 is positioned on the engaged side second bar 73 side of the engaged side holding part 72*a*, and the engaged side holding part 72*a* is formed by a surface facing the engaged side third bar 74 side.

Thus, the engaging side third bar 44 and the engaged side third bar 74 are each positioned in a direction in which the one end side 6*a* or 7*a* of the belt 6 or 7 is pulled, allowing the belt 6 or 7 to be smoothly pulled.

Further, in the buckle 2 according to the present embodiment, the engaging side moving part 60 can be rotated about the engaging side support part 61, and the engaging side leading end part 63 is biased to the engaging side holding part 42*a* from the engaging side third bar 44 side. The engaged side moving part 90 can be rotated about the engaged side support part 91, and the engaged side leading end part 93 is biased to the engaged side holding part 72*a* from the engaged side third bar 74 side.

Thus, to tighten the belt 6 (7), the one end side 6*a* (7*a*) of the belt 6 (7) is pulled to rotate the moving part 60 (90) to thereby release holding of the belt 6 (7) between the leading end part 63 (93) and the holding part 42*a* (72*a*), thus allowing the belt 6 (7) to be pulled. When the belt 6 (7) may be loosened, the leading end part 63 (93) is strongly pressed against the holding part 42*a* (72*a*) thereby preventing the belt 6 (7) from coming loose, which can maintain a belt tightening state more stably.

Further, in the buckle 2 according to the present embodiment, the engaging side moving part 60 has the engaging side extension part 66 extending from the engaging side contacting part 65 contacting the engaging side second bar 43 in a direction away from the engaging side second bar 43, and the engaged side moving part 90 has the engaged side extension part 96 extending from the engaged side contacting part 95 contacting the engaged side second bar 73 in a direction away from the engaged side second bar 73. Thus, in the belt holding structure 1, the moving part 30 can be easily assembled to the base part 10 without use of a tool or the like. Particularly, since the biasing part 34 having flexibility is curved from the support part 31 toward the second bar 13, and the extension part 36 is bent in the direction opposite to the biasing part 34, the moving part 30 can be assembled to the base part 10 more easily.

Further, the buckle 2 according to the present embodiment includes the engaging side belt 6 wound on the engaging side winding part 42*b* of the engaging side first bar 42 from one side of the engaging side virtual line β to the other side thereof, passing the engaging side holding part 42*a* between the engaging side first bar 42 and the engaging side leading end part 63, and contacting the engaging side third bar 44 on the one side of the engaging side virtual line β and the engaged side belt 7 wound on the engaged side winding part 72*b* of the engaged side first bar 72 from one side of the engaged side virtual line γ to the other side thereof, passing the engaged side holding part 72*a* between the engaged side first bar 72 and the engaged side leading end part 93, and contacting the engaged side third bar 74 on the one side of the engaged side virtual line γ. Thus, an object can be detachably held by the belts 6 and 7.

While various embodiments of the present invention have been described, the present invention is not limited to the above embodiments, and an embodiment obtained by appropriately combining configurations of the different embodiments is included in the technical scope of the present invention.

The invention claimed is:

1. A belt holding structure comprising a base part and a moving part, the base part including: two wall parts arranged spaced from each other; a first bar disposed so as to extend over the two wall parts; a second bar disposed so as to be separated from the first bar and to extend over the two wall parts; and a third bar disposed so as to be separated from the first bar and second bar and to extend over the two wall parts, the moving part including: a support part relatively movably attached to the wall parts; an operating part extending from the support part; a leading end part extending from the support part toward the first bar; a biasing part extending while being curved from the support part toward the second bar; and a contacting part extending from the biasing part and contacting, at least partially, the second bar, wherein the second bar is between the operating part and the contacting part, and in a cross-section perpendicular to an extending direction of the support part, the first bar has a holding part that holds a belt together with the leading end part and a winding part on which the belt is wound, the third bar is positioned on one side of a virtual line connecting a point at the holding part at which the belt is held together with the leading end part and a point at the support part before being moved, so as for the third bar to be closer to the holding part than the second bar is, the holding part is formed by a surface facing the third bar, the operating part extends from the support part to the other side relative to the virtual line, and the biasing part generates biasing force in such a direction that the leading end part moves toward the first bar.

2. The belt holding structure according to claim 1, wherein the moving part is rotated about the support part, and the leading end part is biased to the holding part from a third bar side.

3. The belt holding structure according to claim 1, wherein the moving part has an extension part extending curvedly from the contacting part contacting the second bar in a direction away from the second bar.

* * * * *